United States Patent [19]

Stachura et al.

[11] Patent Number: 4,994,201

[45] Date of Patent: Feb. 19, 1991

[54] AZEOTROPE-LIKE COMPOSITIONS OF 1,1-DICHLORO-1-FLUOROETHANE, DICHLOROTRIFLUOROETHANE, METHANOL AND CYCLOPENTANE

[75] Inventors: Leonard M. Stachura, Hamburg; Peter B. Logsdon, Tonawanda; Ellen L. Swan, Ransomville; Rajat S. Basu, Williamsville, all of N.Y.

[73] Assignee: Allied-Signal Inc., Morris Township, Morris County, N.J.

[21] Appl. No.: 412,080

[22] Filed: Sep. 25, 1989

[51] Int. Cl.[5] ..... C11D 7/30; C11D 7/50

[52] U.S. Cl. ..... 252/171; 252/162; 252/170; 252/172; 252/364; 252/DIG. 9; 134/12; 134/38; 134/39; 134/40

[58] Field of Search ..... 252/162, 170, 171, 172, 252/364, DIG. 9; 134/12, 38, 39, 40

[56] References Cited

U.S. PATENT DOCUMENTS 4,894,176 1/1990 Swan ..... 252/171

FOREIGN PATENT DOCUMENTS 1103686 4/1989 Japan .
1136981 5/1989 Japan .
1136982 5/1989 Japan .
1137253 5/1989 Japan .
1137259 5/1989 Japan .
1138300 5/1989 Japan .
1139104 5/1989 Japan .
1139861 6/1989 Japan .

OTHER PUBLICATIONS

Patent application Ser. No.: 362,294 filed, 6/6/89.
Patent application Ser. No.: 297,467 filed, 1/17/89.

*Primary Examiner*—Prince E. Willis
*Assistant Examiner*—Kathleen Markowski
*Attorney, Agent, or Firm*—Colleen D. Szuch; J. P. Friedenson

[57] ABSTRACT

Stable azeotrope-like compositions comprising 1,1-dichloro-1-fluoroethane, dichlorotrifluoroethane, methanol and cyclopentane which are useful in a variety of industrial cleaning applications including cold cleaning and defluxing of printed circuit boards.

21 Claims, No Drawings

AZEOTROPE-LIKE COMPOSITIONS OF 1,1-DICHLORO-1-FLUOROETHANE, DICHLOROTRIFLUOROETHANE, METHANOL AND CYCLOPENTANE

FIELD OF THE INVENTION

This invention relates to azeotrope-like mixtures of 1.1-dichloro-1-fluoroethane, dichlorotrifluoroethane, methanol and cyclopentane. These mixtures are useful in a variety of vapor degreasing, cold cleaning and solvent cleaning applications including defluxing.

CROSS-REFERENCES TO RELATED APPLICATIONS

Co-pending, commonly assigned application Ser. No.: 297,467, filed Jan. 19 1989, discloses azeotrope-like mixtures of 1,1-dichloro-1-fluoroethane, 1,1,-dichloro-2,2,2-trifluoroethane and methanol.

Co-pending, commonly assigned application Ser. No.: 330,252, filed Mar. 29, 1989, discloses azeotrope-like mixtures of 1,1-dichloro-1-fluoroethane, 1,1-dichloro-2,2,2-trifluoroethane and ethanol.

Co-pending commonly assigned application Ser. No.: 362,294, filed June 6, 1989, discloses azeotrope-like mixtures of 1,1-dichloro-1-fluoroethane and 1,1-dichloro-2,2,2-trifluoroethane.

BACKGROUND OF THE INVENTION

Fluorocarbon based solvents have been used extensively for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent leaves the object free of residue. This is contrasted with liquid solvents which leave deposits on the object after rinsing.

A vapor degreaser is used for difficult to remove soils where elevated temperature is necessary to improve the cleaning action of the solvent, or for large volume assembly line operations where the cleaning of metal parts and assemblies must be done efficiently. The conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al., in U.S. Pat. No. 3,085,918 disclose such suitable vapor decreasers comprising a boiling sump, a clean sump, a water separator, and other ancillary equipment.

Cold cleaning is another application where a number of solvents are used. In most cold cleaning applications, the soiled part is either immersed in the fluid or wiped with cloths soaked in solvents and allowed to air dry.

Recently, nontoxic nonflammable fluorocarbon solvents like trichlorotrifluoroethane have been used extensively in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions having fluorocarbon components because the fluorocarbon components contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Therefore, unless the solvent composition is essentially constant boiling, fractionation will occur and undesirable solvent distribution may act to upset the cleaning and safety of processing. For example, preferential evaporation of the more volatile components of the solvent mixtures, would result in mixtures with changed compositions which may have less desirable properties, like lower solvency towards soils, less inertness towards metal, plastic or elastomer components, and increased flammability and toxicity.

The art is continually seeking new fluorocarbon based azeotrope mixtures or azeotrope-like mixtures which offer alternatives for new and special applications for vapor degreasing and other cleaning applications. Currently, fluorocarbon based azeotrope-like mixtures are of particular interest because they are considered to be stratospherically safe substitutes for presently used fully halogenated chlorofluorocarbons. The latter have been implicated in causing environmental problems associated with the depletion of the earth's protective ozone layer. Mathematical models have substantiated that hydrochlorofluorocarbons, like 1,1-dichloro-1-fluoroethane (HCFC-141b) and dichlorotrifluoroethane (HCFC-123 and HCFC-123a), have a much lower ozone depletion potential and global warming potential than the fully halogenated species.

Accordingly, it is an object of the invention to provide novel environmentally acceptable azeotropic compositions useful in a variety of industrial cleaning applications.

It is another object of the invention to provide azeotrope-like compositions which are liquid at room temperature and which will not fractionate under conditions of use.

Other objects and advantages of the invention will become apparent from the following description.

SUMMARY OF THE INVENTION

The invention relates to novel azeotrope-like compositions which are useful in a variety of industrial cleaning applications. Specifically, the invention relates to compositions based on 1,1-dichloro-1-fluoroethane, dichlorotrifluoroethane, methanol, and cyclopentane which are essentially constant boiling, environmentally acceptable, non-fractionating, and which remain liquid at room temperature.

DETAILED DESCRIPTION OF THE INVENTION

In accordance with the invention, novel azeotrope-like compositions have been discovered comprising 1,1-dichloro-1-fluoroethane (HCFC-141b), dichlorotrifluoroethane, methanol and cyclopentane. Dichlorotrifluoroethane exists in three isomeric forms, 1,1-dichloro-2,2,2-trifluoroethane (HCFC-123), 1,2-dichloro-1,2,2-trifluoroethane (HCFC-123a), and 1,1-dichloro-1,2,2-trifluoroethane (HCFC-123b). For purposes of this invention, dichlorotrifluoroethane will refer only to the HCFC-123 and HCFC-123a isomers. Each of these isomers exhibits the properties of the invention. Hence, either isomer may be used as well as mixtures of the isomers in any proportion.

Commercially available cyclopentane may be used in the present invention. Commercial grade cyclopentane contains impurities such as 2,2-dimethylbutane: 2,3-dimethylbutane; 2-methylpentane; 3-methylpentane; and n-hexane.

HCFC-123 is the preferred isomer. Commercial HCFC-123 contains from about 90.0 to about 95.0 weight percent HCFC-123 from about 5.0 to about 10.0 weight percent HCFC-123a, and impurities like trichloromonofluoromethane, trichlorotrifluoroethane, and methylene chloride. However, because they are present insignificant amounts, these impurities have no deleterious effect on the properties of the azeotrope-like compositions. HCFC-123 is also available in an "ultra pure" form. "Ultra pure" HCFC-123 contains from about 95.0 to about 99.5 weight percent HCFC-123, from about 0.5 to about 5.0 weight percent HCFC-123a, and impurities listed above.

Novel azeotrope-like compositions comprise 1,1-dichloro-1-fluoroethane; dichlorotrifluoroethane; cyclopentane; and methanol which boil at about 29.8° C ± about 0.5° C at 760 mm Hg.

The azeotrope-like compositions of the invention comprise from about 43.0 to about 93.7 weight percent HCFC-141b, from about 5.0 to about 50.0 weight percent dichlorotrifluoroethane, from about 0.3 to about 3.0 weight percent cyclopentane and from about 1.0 to about 4.0 weight percent methanol.

In a preferred embodiment of the invention, the azeotrope-like compositions comprise from about 57.0 to about 93.7 weight percent HCFC-141b from about 5.0 to about 36.0 weight percent dichlorotrifluoroethane, from about 0.3 to about 3.0 weight percent cyclopentane and from about 1.0 to about 4.0 weight percent methanol.

In a more preferred embodiment of the invention, the azeotrope-like compositions comprise from about 58.0 to about 89.5 weight percent HCFC-141b, from about 8.0 to about 35.0 weight percent dichlorotrifluoroethane, from about 0.5 to about 3.0 weight percent cyclopentane and from about 2.0 to about 4.0 weight percent methanol.

In the most preferred embodiment of the invention, the azeotrope-like compositions comprise from about 87.9 to about 62.4 weight percent HCFC-141b, from about 10.0 to about 31.0 weight percent dichlorotrifluoroethane, from about 0.6 to about 2.8 weight percent cyclopentane, and from about 1.5 to about 3.8 weight percent methanol.

The compositions of the invention containing a mixture of HCFC-123 and HCFC-123a behave like azeotropic compositions because the separate ternary azeotrope-like compositions with HCFC-123 and HCFC-123a have boiling points so close to one another that they are virtually indistinguishable.

When a mixture of HCFC-123 and 123a is used, the composition of the invention comprise from about 23.0 to about 93.7 weight percent 1,1-dichloro-1-fluoroethane, from about 5.0 to about 70.0 weight percent of a mixture of HCFC-123/HCFC-123a, from about 0.3 to about 3.0 weight percent cyclopentane, and from about 1.0 to about 4.0 weight percent methanol.

In the most preferred embodiment of the invention utilizing a mixture of HCFC-123/HCFC-123a, the composition contains from about 43.4 to about 87.9 weight percent 1,1-dichloro-1-fluoroethane, from about 10.0 to about 50.0 weight percent of a mixture of HCFC-123/HCFC-123a, from about 0.6 to about 2.8 weight percent cyclopentane, and from about 1.5 to about 3.8 weight percent methanol.

It is known in the art that the use of more active solvents, such as lower alkanols in combination with certain halocarbons such as trichlorotrifluoroethane, may have the undesirable result of attacking reactive metals such as zinc and aluminum, as well as certain aluminum alloys and chromate coatings such as are commonly employed in circuit board assemblies. The art has recognized that certain stabilizers, like nitromethane, are effective in preventing metal attack by chlorofluorocarbon mixtures with such alkanols. Other candidate stabilizers for this purpose, such as disclosed in the literature, are secondary and tertiary amines, olefins and cycloolefins, alkylene oxides, sulfoxides, sulfones, nitrites and nitriles, and acetylenic alcohols or ethers. It is contemplated that such stabilizers as well as other additives may be combined with the azeotrope-like compositions of this invention.

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Tag Open Cup test method—ASTM D 1310-86.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore in vapor phase solvent cleaning as described above.

For purposes of this discussion, the term "azeotrope-like composition" is intended to mean that the composition behaves like a true azeotrope in terms of its constant-boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only slightly. This is contrasted with non-azeotrope-like compositions in which the liquid composition changes substantially during boiling or evaporation.

Thus, one way to determine whether a candidate mixture is "azeotrope-like" within the meaning of this invention, is to distill a sample thereof under conditions (i.e. resolution—number of plates) which would be expected to separate the mixture into its components. If the mixture is non-azeotropic or non-azeotrope-like, the mixture will fractionate, with the lowest boiling component distilling off first, etc. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above discussion that another characteristic of azeotrope-like compositions is that there is a range of compositions containing the same components in varying proportions which are azeotrope-like. All such compositions are intended to be covered by the term azeotrope-like as used herein. As an example, it is well known that at different pressures, the composition of a given azeotrope will vary at least slightly as does the boiling point of the composition. Thus, an azeotrope of A and B represents a unique type of relationship but with a variable composition depending on temperature and/or pressure. Accordingly, another way of defining azeotrope-like within the meaning of this invention is to state that such mixtures boil within about ±0.5° C (at 760 mm Hg) of the boiling point of the most preferred compositions disclosed herein, i.e., 29.8° C at 760 mm Hg. As is readily understood by persons skilled in the art, the boiling point of the azeotrope will vary with the pressure.

In the process embodiment of the invention, the azeotrope-like compositions of the invention may be used to clean solid surfaces by treating said surfaces with said compositions in any manner well known to the art such as by dipping or spraying or use of conventional degreasing apparatus.

The HCFC-141b, dichlorotrifluoroethane, methanol and cyclopentane components of the invention are known materials. Preferably they should be used in sufficiently high purity so as to avoid the introduction of adverse influences upon the solvency properties or constant-boiling properties of the system.

It should be understood that the present compositions may include additional components so as to form new azeotrope-like or constant-boiling compositions. Any such compositions are considered to be within the scope of the present invention as long as the compositions are constant-boiling or essentially constant-boiling and contain all of the essential components described herein.

The present invention is more fully illustrated by the following non-limiting Examples.

EXAMPLES 1-5

This set of examples further confirms the existence of the azeotropes between 1,1-dichloro-1-fluoroethane, methanol, dichlorotrifluoroethane and cyclopentane via the method of distillation. It also illustrates that these mixtures do not fractionate during distillation.

A 5-plate Oldershaw distillation column with a cold water condensed automatic liquid dividing head was used in these examples. For Examples 1-3, the distillation column was charged with approximately 350 grams of a mixture of HCFC-141b, HCFC-123, methanol and cyclopentane while in Examples 4-5, the distillation column was charged with approximately 350 grams of a mixture of HCFC-141b, HCFC-123a, methanol and cyclopentane. The mixtures were heated under total reflux for about an hour to ensure equilibration. A reflux ratio of 3:1 was employed for these particular distillations. Approximately 50 percent of the original charges were collected in four similar-sized overhead fractions. The compositions of these fractions were analyzed using gas chromatrography. Table I shows the composition of the starting materials. The averages of the distillate fractions and the overhead temperatures are quite constant within the uncertainty associated with determining the compositions, indicating that the mixtures are azeotrope-like.

TABLE I

| | STARTING MATERIAL (WT. %) | | | |
|---|---|---|---|---|
| EXAMPLE | HCFC-141b | HCFC-123 | METHANOL | CYCLOPENTANE |
| 1 | 85.2 | 9.8 | 3.0 | 2.0 |
| 2 | 70.2 | 24.5 | 3.1 | 2.2 |
| 3 | 89.7 | 5.2 | 3.6 | 1.5 |
| EXAMPLE | HCFC-141b | HCFC-123a | METHANOL | CYCLOPENTANE |
| 4 | 85.5 | 9.4 | 3.4 | 1.0 |
| 5 | 65.5 | 30.5 | 3.0 | 1.0 |
| | DISTILLATE COMPOSITION (WT. %) | | | |
| EXAMPLE | HCFC-141b | HCFC-123 | METHANOL | CYCLOPENTANE |
| 1 | 85.0 | 9.8 | 3.5 | 1.6 |
| 2 | 69.8 | 25.4 | 2.8 | 1.9 |
| 3 | 90.2 | 5.0 | 3.7 | 1.0 |
| EXAMPLE | HCFC-141b | HCFC-123a | METHANOL | CYCLOPENTANE |
| 4 | 86.4 | 9.5 | 3.4 | 0.8 |
| 5 | 65.5 | 30.6 | 3.0 | 0.9 |

| EXAMPLE | BOILING POINT(°C) | BAROMETRIC PRESSURE (mm Hg) | BOILING POINT CORRECTED TO 760 mm Hg(°C) |
|---|---|---|---|
| 1 | 28.9 | 734.9 | 29.7 |
| 2 | 29.2 | 748.3 | 29.6 |
| 3 | 29.5 | 737.0 | 30.1 |

TABLE I-continued

| | | | |
|---|---|---|---|
| | | | Mean: 29.8° C. ± 0.3° C. |
| 4 | 28.9 | 743.6 | 29.4 |
| 5 | 29.7 | 743.6 | 30.3 |
| | | | Mean: 29.8° C. ± 0.5° C. |

Examples 1–3 illustrate that HCFC-141b, HCFC-123, cyclopentane and methanol form a constant-boiling mixture while Examples 4–5 indicate that HCFC-141b, HCFC-123a, cyclopentane, and methanol form a constant-boiling mixture.

EXAMPLES 6–7

The azeotrope-like properties of HCFC-141b, a mixture of HCFC-123/HCFC-123a, methanol, and cyclopentane are studied by repeating the experiment outlined in Examples 1–5 above. The results obtained are substantially the same as those for HCFC-123 and HCFC-123a, i.e., HCFC-141b, a mixture of HCFC-123/HCFC-123a, methanol and cyclopentane form a constant boiling mixture.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 23 to about 93.7 weight percent 1,1-dichloro-1-fluoroethane, from about 5 to about 70 weight percent dichlorotrifluoroethane selected from the group consisting of 1,1-dichloro-2,2,2-trifluoroethane, 1,2-dichloro-1,2,2-trifluoroethane and a mixture of 1,1-dichloro-2,2,2-trifluoroethane and 1,2-dichloro-1,2,2-trifluoroethane, from about 0.3 to about 3 weight percent cyclopentane and from about 1 to about 4 weight percent methanol which boil at about 29.8° C at 760 mm Hg.

2. Azeotrope-like compositions consisting essentially of from about 43.0 to about 93.7 weight percent 1,1-dichloro-1-fluoroethane, from about 5.0 to about 50.0 weight percent dichlorotrifluoroethane selected from the group consisting of 1,1-dichloro-2,2,2-trifluoroethane, 1,2-dichloro-1,2,2-trifluoroethane and a mixture of 1,1-dichloro-2,2,2-trifluoroethane and 1,2-dichloro-1,2,2-trifluoroethane, from about 0.3 to about 3.0 weight percent cyclopentane and from about 1.0 to about 4.0 weight percent methanol which boil at about 29.8° C at 760 mm Hg.

3. The azeotrope-like compositions of claim 2 consisting essentially of from about 57.0 to about 93.7 weight percent 1,1-dichloro-1-fluoroethane, from about 5.0 to about 36.0 weight percent dichlorotrifluoroethane, from about 0.3 to about 3.0 weight percent cyclopentane and from about 1.0 to about 4.0 weight percent methanol.

4. The azeotrope-like compositions of claim 2 consisting essentially of from about 58.0 to about 89.5 weight percent 1,1-dichloro-1-fluoroethane, from about 8.0 to about 35.0 weight percent dichlorotrifluoroethane, from about 0.5 to about 3.0 weight percent cyclopentane and from about 2.0 to about 4.0 weight percent methanol.

5. The azeotrope-like compositions of claim 2 consisting essentially of from about 62.4 to about 87.9 weight percent 1,1-dichloro-1-fluoroethane, from about 10.0 to about 31.0 weight percent dichlorotrifluoroethane, from about 0.6 to about 2.8 weight percent cyclopentane, and from about 1.5 to about 3.8 weight percent methanol.

6. Azeotrope-like compositions consisting essentially of from about 23.0 to about 93.7 weight percent 1,1-dichloro-1-fluoroethane, from about 5.0 to about 70.0 weight percent of a mixture of 1,2-dichloro-1,2,2-trifluoroethane and 1,1-dichloro-2,2,2-trifluoroethane, from about 0.3 to about 3.0 weight percent cyclopentane and from about 1.0 to about 4.0 weight percent methanol which boil about 29.8° C at 760 mm Hg.

7. The azeotrope-like compositions of claim 6 consisting essentially of from about 43.4 to about 87.9 weight percent 1,1-dichloro-1-fluoroethane, from about 10.0 to about 50.0 weight percent of a mixture of 1,1-dichloro-2,2,2-trifluoroethane and 1,2-dichloro-1,2,2-trifluoroethane, from about 0.6 to about 2.8 weight percent cyclopentane, and from about 1.0 to about 4.0 weight percent methanol.

8. The azeotrope-like compositions of claim 1 wherein said dichlorotrifluoroethane is 1,1-dichloro-2,2,2-trifluoroethane.

9. The azeotrope-like compositions of claim 1 wherein said dichlorotrifluoroethane is 1,2-dichloro-1,2,2-trifluoroethane.

10. The azeotrope-like compositions of claim 1 wherein said dichlorotrifluoroethane is a mixture of 1,1-dichloro-2,2,2-trifluoroethane and 1,2-dichloro-1,2,2-trifluoroethane.

11. The azeotrope-like compositions of claim 1 wherein said compositions additionally consist of a stabilizer.

12. The azeotrope-like compositions of claim 2 wherein said dichlorotrifluoroethane is 1,1-dichloro-2,2,2-trifluoroethane.

13. The azeotrope-like compositions of claim 2 wherein said dichlorotrifluoroethane is 1,2-dichloro-1,2,2-trifluoroethane.

14. The azeotrope-like compositions of claim 2 wherein said compositions additionally consist of a stabilizer.

15. The azeotrope-like compositions of claim 6 wherein said compositions additionally consist of a stabilizer.

16. The azeotrope-like compositions of claim 7 wherein said compositions additionally consist of a stabilizer.

17. A method of cleaning a solid surface comprising treating said surface with said azeotrope-like composition of claim 1.

18. A method of cleaning a solid surface comprising treating said surface with said azeotrope-like composition of claim 2.

19. A method of cleaning a solid surface comprising treating said surface with said azeotrope-like composition of claim 6.

20. A method of cleaning a solid surface comprising treating said surface with said azeotrope-like composition of claim 7.

21. The azeotrope-like compositions of claim 1 wherein said compositions boil at about 29.8° C ± about 0.5° C at 760 mm Hg.

* * * * *